US005800031A

United States Patent [19]

Hanneman et al.

[11] Patent Number: 5,800,031

[45] Date of Patent: Sep. 1, 1998

[54] PANTYHOSE ORGANIZER FOR DRESSER OR BUREAU

[76] Inventors: Keith Hanneman; Renee Hanneman, both of 1471 Sandalwood Dr., Dunedin, Fla. 34698

[21] Appl. No.: 733,961

[22] Filed: Oct. 21, 1996

[51] Int. Cl.[6] ..... A47B 88/20

[52] U.S. Cl. ..... 312/348.3; 312/107; 312/291

[58] Field of Search ..... 312/107, 291, 312/348.3; 206/292, 564, 561; 220/408, 410

[56] References Cited

U.S. PATENT DOCUMENTS

| | | | |
|---|---|---|---|
| 1,840,485 | 1/1932 | Butler | 312/348.3 X |
| 1,852,652 | 4/1932 | Harris | 312/291 X |
| 3,322,310 | 5/1967 | Higgs | 312/902 X |
| 3,729,242 | 4/1973 | Barney | 312/107 |
| 4,437,714 | 3/1984 | Struck | 108/25 X |
| 4,786,785 | 11/1988 | Felt | 312/291 X |
| 5,069,514 | 12/1991 | Sherman | 312/348.3 |
| 5,172,649 | 12/1992 | Bourgeois | 119/3 |
| 5,244,265 | 9/1993 | Chiang | 312/107 |
| 5,244,268 | 9/1993 | Derrickson | 312/293.2 X |
| 5,402,738 | 4/1995 | Carr et al. | 108/157 |
| 5,556,181 | 9/1996 | Bertrand | 108/25 X |

*Primary Examiner*—Peter M. Cuomo
*Assistant Examiner*—Stephen Vu
*Attorney, Agent, or Firm*—Charles E. Lykes, Jr., Esq.

[57] ABSTRACT

A unique and improved storage compartment for storing and positioning footwear, such as socks and pantyhose, for organized storage and retrieval within a bureau or dresser drawer.

4 Claims, 3 Drawing Sheets

PANTYHOSE ORGANIZER FOR DRESSER OR BUREAU

The invention relates to storage and compartment accessories meant to be housed within a bureau or dresser, particularly those for the storage of small footwear items such as pantyhose and socks. Reference is made to the disclosure document filed by the inventor on Mar. 20, 1996, as evidenced by the attached return post card and cancelled check.

BACKGROUND OF THE INVENTION

It is helpful for persons to have the ability to prepare, organize, and plan their clothing in advance. One-week periods seem particularly well suited for this because most persons have a scheduled work week and free time on the weekend for organizing their personal lives.

Items which many persons take for granted are small accessory clothing such as footwear and/or pantyhose. These items are typically stored in a drawer with many thrown in together. This results in them getting tangled with each other or in persons discovering that a desired color or shade combination is not available. These items, particularly feminine clothing, are sheer and lightweight and particularly prone to tearing or ripping.

It is helpful then to have some means of organizing and planning a wardrobe for a one-week interval, particularly regarding pantyhose, socks, or undergarments. Previous efforts have been made to provide such a device. These include U.S. Pat. No. 5,069,514, issued to Sherman, on Dec. 3, 1991 (which is a multiple pantyhose storage apparatus comprising an organized series of squared compartments); U.S. Pat. No. 5,292,571, issued to Quinn, on Mar. 8, 1994 (which includes an undulating series of recessed sides forming odd-shaped cavities; U.S. Pat. No. 5,242,223, issued to Koves, on Sep. 7, 1993 (which comprises an adjustable series of drawer-dividing devices with squared corners and upright members); U.S. Pat. No. 5,147,119, issued to Harris, on Sep. 15, 1992 (which includes an upright stacking storage tube for storing and dispensing socks); U.S. Pat. No. 4,595,246, issued to Bross, on Jun. 17, 1986 (which comprises a series of interlocking upright drawer-dividing members); and U.S. Pat. No. 2,268,637, issued to Bernstein, on Jan. 6, 1942 (which teaches interlocking upright dividing members suitable for use in drawers or upright shelves.

What is not provided in the prior art is such an organizer which is specifically designed for lightweight sheer materials and is further adapted to provide a means of offering a one-week organization of such pantyhose or undergarments, together with means for transporting or delivering such undergarments conveniently to a laundry operation.

SUMMARY OF THE INVENTION

The Inventor has solved the problems remaining from the prior art by designing a small and convenient accessory for storing pantyhose or small socks. The accessory is designed to fit easily within a dresser drawer or other similar cover.

Generally, the invention comprises an open-face container with six or so compartments for storing clothing items and another elongated or larger compartment for storing a carrying case or other footwear or pantyhose accessory.

The idea is to provide the user with a means of planning footwear for a week in advance and then having available the container or bag required to deliver the used items to the laundry or cleaners. The accessory could be sold as a single compartment unit or as a kit which includes the laundry-type bag or container.

It is then an object of the present invention to provide a pantyhose or sock organizer especially adapted to assist with a one-week supply of sock or pantyhose wear.

It is a further object of the present invention to provide such an organizing container which may easily fit within a dresser drawer.

It is a further object of the present invention to provide such a container which will safely remain in its position in a dresser drawer or other covering.

It is a further object of the present invention to provide such a container and adapt it with a kit to facilitate the cleaning, storage and protection of such items.

It is a further object of the present invention to adapt such a storage container with features to simplify the ease and handling of the footwear items and to protect them from unnecessary damage or wear.

Other features and advantages of the present invention will be apparent from the following description in which the preferred embodiments have been set forth in conjunction with the accompanying drawings.

BRIEF DESCRIPTION OF THE DRAWINGS

In describing the preferred embodiments of the invention reference will be made to the series of figures and drawings briefly described below.

Figure 1:
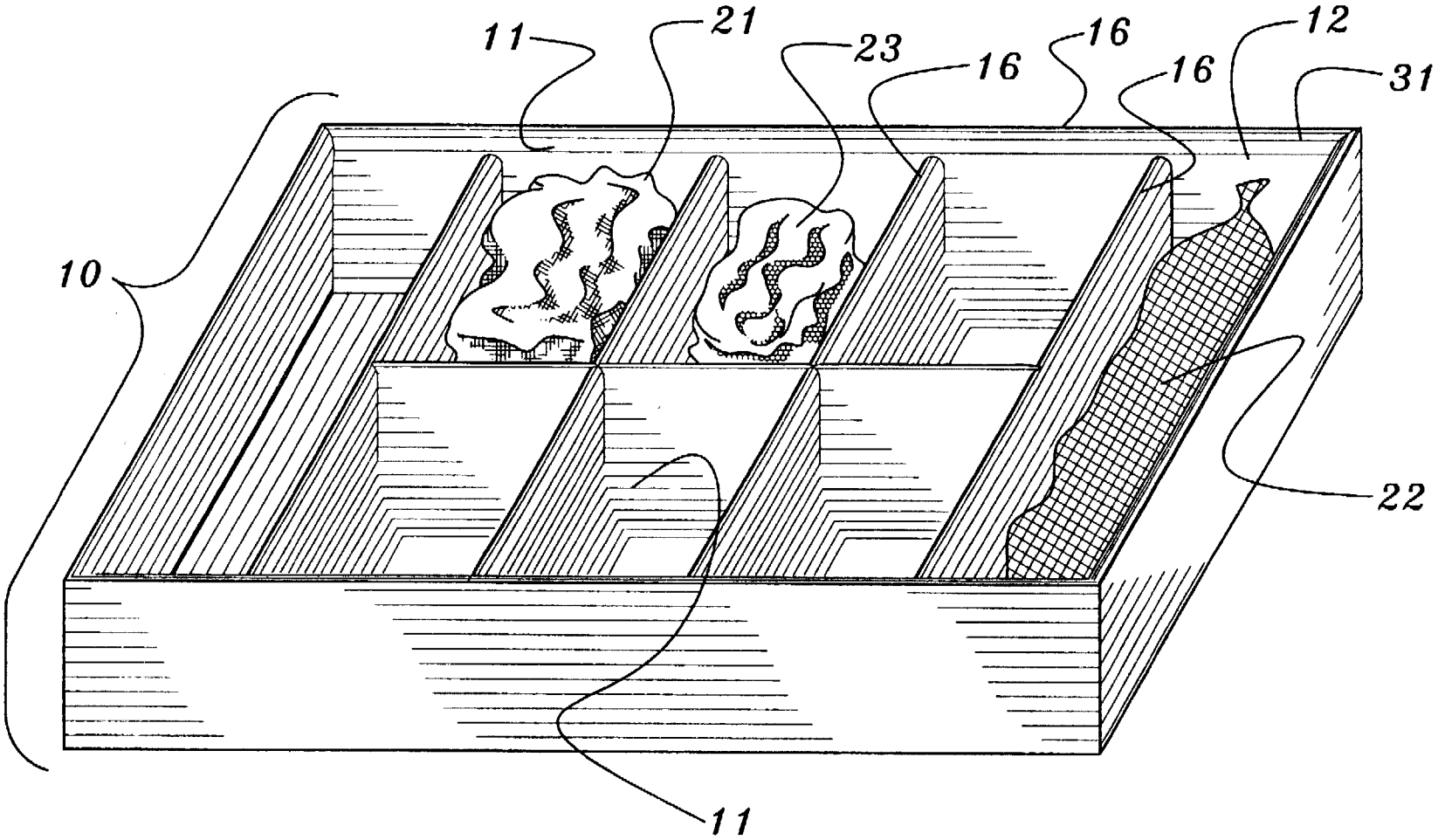
FIG. 1 is an oblique view of the pantyhose or sock storage accessory as described herein.
Figure 2:
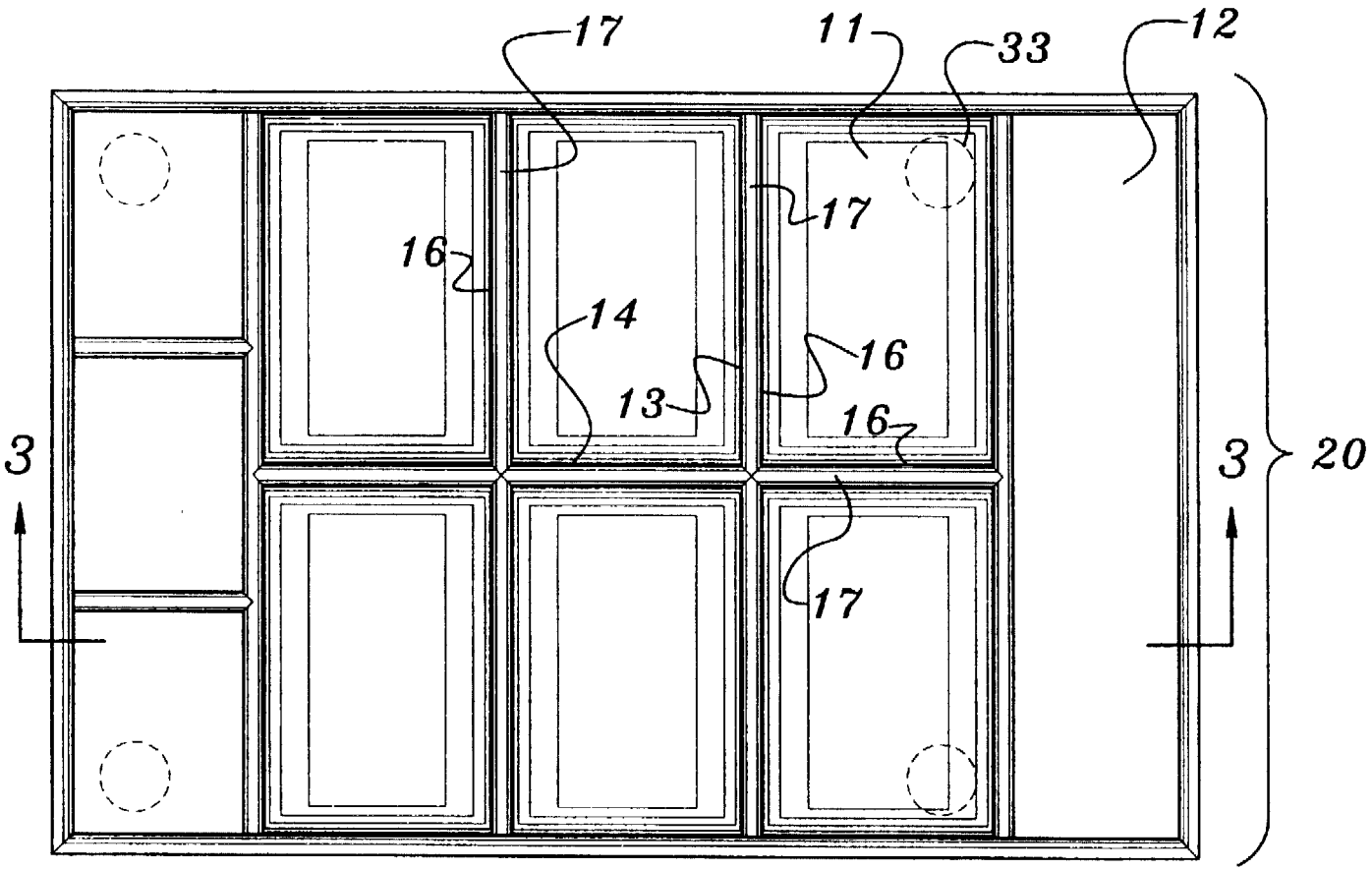
FIG. 2 is a top view of such container.

While certain drawings have been provided in order to teach the principles and operation of the present invention, it should be understood that, in the detailed description which follows, reference may be made to components or apparatus which are not included in the drawings. Such components and apparatus should be considered as part of the description, even if not included in such a drawing. Likewise, the drawings may include an element, structure, or mechanism which is not described in the textual description of the invention which follows. The invention and description should also be understood to include such a mechanism, component, or element which is depicted in the drawing but not specifically described.

DETAILED DESCRIPTION OF THE PREFERRED EMBODIMENT

Reference will now be made in detail to the present preferred embodiment of the invention, an example of which is illustrated in the accompanying drawings. While the invention will be described in connection with a preferred embodiment, it will be understood that it is not intended to limit the invention to that embodiment. On the contrary, it is intended to cover all alternatives, modifications, and equivalents as may be included within the spirit and scope of the invention defined in the appended claims.

Making reference first to FIG. 1, it can be seen that the pantyhose container (10) is a generally flat and narrow accessory which may be divided into six regular compartments (11) and one elongated or larger compartment (12). The compartments (11, 12) are accessible through an open top side (31, FIG. 3) which permits small items (21) to easily be placed within or withdrawn from each said compartment (11, 12). As it is anticipated that the entire apparatus (10) will be stored within a drawer, there is no need to provide it with a top or a cover as dust will not be allowed to migrate about the area of the container, although such could be included as an option for traveling. Accordingly, FIG. 3 depicts such a cover.

In consideration of the weekly schedule of most persons, it is anticipated that six compartments would be appropriate for five days of work and one day of church or perhaps other formal social function with one day for recreational or informal activities which would not require dress-type socks or hosiery clothing articles. Accordingly, six smaller compartments (11) were considered and are depicted. It is possible, however, in keeping within the spirit and scope of the present invention, to use any described number of smaller compartments (11) from two or more. Such other numbers may easily be envisioned from the accompanying drawings and are, consequently, not separately depicted.

Within the elongated compartment (12) may be positioned a laundry bag (22) or other carrying case which may be used to carry the pantyhose (23) to the laundry and could even be used to keep socks or pantyhose (23) together for ease of washing and organizing together at the same time. For such purposes a netted laundry bag (22) would be used and such would afford extra safety or protection to the pantyhose as they are washed.

Figure 3:
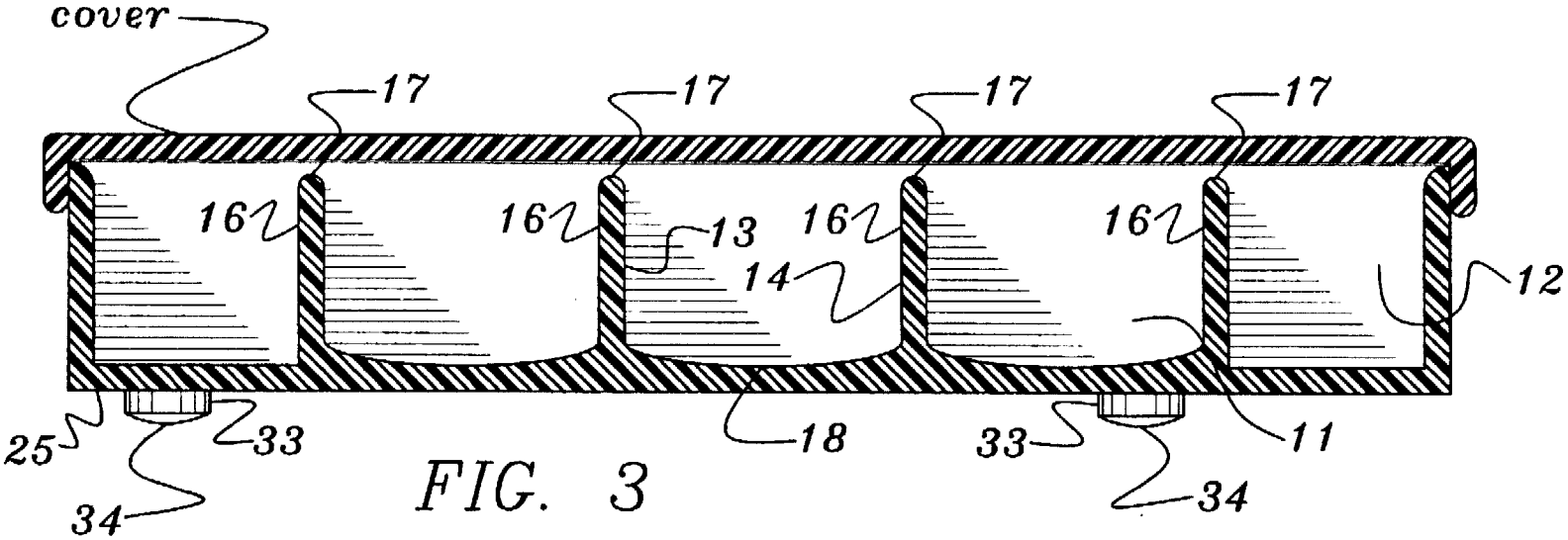
FIG. 3 is a cross-sectional view depicting the safety features of the present-invention.

Making reference now to FIG. 3, it is important to note certain features of the cross-section of the present invention. One of these is that the interior surfaces (13, 14) of the interior compartments (11, 12) within which the pantyhose (23) or socks will be stored should be smooth surfaces (13, 14). This is because such clothing items are often sheer and sensitive and would tear if exposed to rough edges or sharp points or nooks or crannies as exist in present drawer dividers. In order to enhance this protective nature of the apparatus (10), it should also be noted that edges (16) surrounding the tops (17) of the interior compartments (11, 12) are also curved or rounded so as to prevent contact of the pantyhose (23) or socks with even a sharp edge at the top of the container. In order to facilitate the retrieval of socks or pantyhose (23) from each compartment (11, 12), the bottom (18) of the compartment may also be made curved or concave. This enables a person to put his or her fingers into the compartments (11, 12) and "scoop" the article out of the compartment (11, 12) very easily rather than slide the pantyhose (23) into a corner along the bottom and struggle with it to get a good grip.

Figure 4:
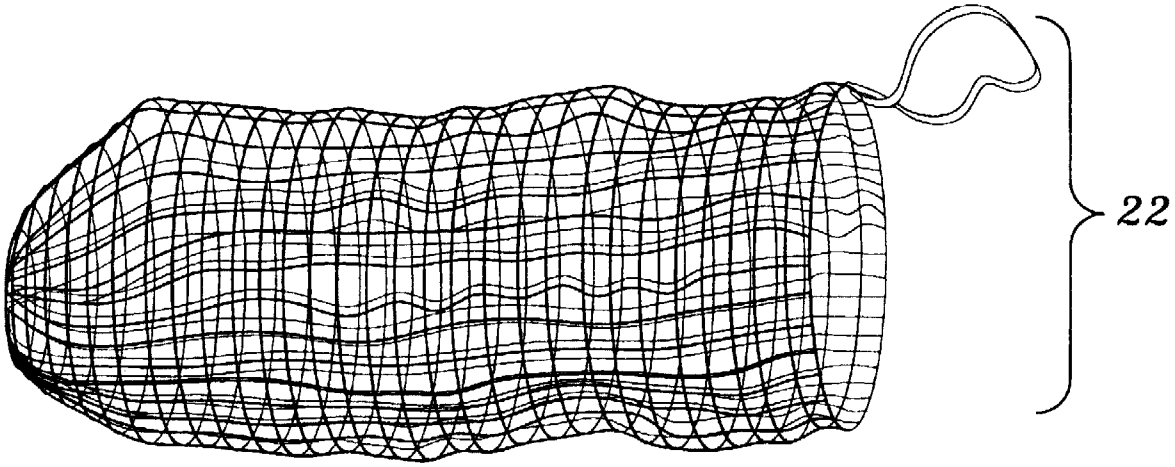
FIG. 4 depicts a laundry bag which may be used with the present invention.

Making reference to FIG. 4, it can be seen that the laundry bag (22) may comprise a webbing- or netting-type material which would be large enough to easily contain a pair of pantyhose (23) or socks but would also freely permit cleaning water to flow in and out without significant interruption. In this manner, the socks or pantyhose (23) could be kept in a single clump and washed together. This would avoid the problems often inherent in keeping pairs of socks or hosiery together in a matched set.

Making reference again to FIG. 3, the cross-section, it can be seen that the flat bottom (25) of the compartment apparatus (10) could be adapted with short legs (33) which are further adapted with rubber or other high-friction tips (34) in order to prevent the compartment from sliding or moving around in the dresser or bureau drawer. Accordingly, the compartment apparatus could be positioned at the front of the bureau or drawer (not depicted) and reliably remain there with routine opening and closing of the drawer so that additional or extra socks or pantyhose could be placed in the back of the bureau or drawer for retrieval as necessary.

It would be possible, and maybe desirable, to line the interior surfaces of the compartments (11, 12) with a soft and pliable fabric material in order to enhance the appearance as well as provide an even safer surface to sheer clothing articles. Such fabric may be scented in order to enhance the comfort of the user if and when dirty garments are stored within the bag. Such alternative may easily be envisioned and need not be separately depicted.

Modification and variation can be made to the disclosed embodiments without departing from the subject and spirit of the invention as defined in the following claims. Such modifications and variations, as included within the scope of these claims, are meant to be considered part of the invention as described.

What is claimed is:

1. A tray apparatus for storing and organizing hosiery or small delicate clothing articles within a dresser or bureau drawer comprising:

a container comprising an outer shell which further comprises a plurality of inner compartments, said outer shell having a closed bottom, four sides, and an open top;

said inner compartments comprising a series of smaller compartments of substantially equal height which are open at the top and are of suitable size for storing at least one pair of pantyhose, each said smaller compartment further comprising a bottom with a surrounding enclosure;

said inner compartments further comprising at least one elongated compartment, said elongated compartment being of adequate size to store a laundry bag;

each said inner compartment further comprising an interior lower exposed surface which is slightly concave and which further is joined to said side surrounding enclosure in a continuous manner without a sharp edge, wherein a top edge of each said side surrounding enclosure is rounded so as to avoid any sharp surfaces upon which an item of clothing might sag; and a netted bag having an interior space, adapted to hold a plurality of pairs of pantyhose, said netted bag being further adapted to permit a laundry washing fluid to pass easily in and out of said netted bag when enclosed within a laundry washing fluid environment.

2. The tray apparatus for storing and organizing hosiery or small delicate clothing articles within a dresser or bureau drawer described in claim 1, in which said container has an exterior bottom surface and at least three short legs with high friction tips so that said apparatus will not slide within a bureau or dresser drawer.

3. The tray apparatus for storing and organizing hosiery or small delicate clothing articles within a dresser or bureau drawer described in claim 1, in which each said interior compartment is lined with a soft and pliable fabric material.

4. The tray apparatus for storing and organizing hosiery or small delicate clothing articles within a dresser or bureau drawer described in claim 2, in which each said interior compartment is lined with a soft and pliable fabric material.

* * * * *